US007237465B2

(12) United States Patent
Huang

(10) Patent No.: US 7,237,465 B2
(45) Date of Patent: Jul. 3, 2007

(54) OPERATION MECHANISM FOR PRESSING BOARD OF ELECTRIC PAPER CUTTERS

(76) Inventor: Chien Kai Huang, No. 136, Tsu Chiang Road., Chang Hua City. (TW)

( * ) Notice: Subject to any disclaimer, the term of this patent is extended or adjusted under 35 U.S.C. 154(b) by 305 days.

(21) Appl. No.: 11/065,116

(22) Filed: Feb. 24, 2005

(65) Prior Publication Data

US 2006/0185489 A1 Aug. 24, 2006

(51) Int. Cl.
*B26D 7/02* (2006.01)

(52) U.S. Cl. ..... 83/452; 83/462; 83/466; 269/225

(58) Field of Classification Search ..... 83/451–466, 83/375, 377, 383, 385, 386, 388, 389, 390; 100/289, 8, 10, 11, 16, 214; 269/55, 56, 269/225, 227, 111
See application file for complete search history.

(56) References Cited

U.S. PATENT DOCUMENTS 1,547,828 A * 7/1925 Schroeter ..... 269/227
2,054,505 A * 9/1936 Laessker ..... 83/389
2,449,172 A * 9/1948 McBride ..... 83/390
2,506,436 A * 5/1950 Seybold ..... 269/32
3,105,679 A * 10/1963 Westra ..... 269/32
3,272,050 A * 9/1966 Barley ..... 83/390
3,648,552 A * 3/1972 Bradley ..... 83/390
3,754,492 A * 8/1973 Krauss ..... 83/380
3,987,694 A * 10/1976 Kaufman ..... 83/453
5,740,710 A * 4/1998 Gross et al. ..... 83/462
6,874,410 B1 * 4/2005 Huang ..... 83/464

* cited by examiner

*Primary Examiner*—Stephen Choi
(74) *Attorney, Agent, or Firm*—Bacon & Thomas, PLLC

(57) ABSTRACT

A pressing board operation mechanism for paper cutter includes an eccentric driving rod to pivot a first link assembly composed of two pairs of triangular plates and the first link assembly is connected to a second link assembly which includes a rack member, two first links and two second links. The two first links are operationally connected to the rack member by two respective rack ends and the two second links are pivotably connected between the first links and the pressing board which is lowered or lifted by the pivotal movement of the first and second links. Two sensors are provided and activated when the first link assembly is moved to a pre-set positions and the sensors send commands to stop the motor.

3 Claims, 7 Drawing Sheets

OPERATION MECHANISM FOR PRESSING BOARD OF ELECTRIC PAPER CUTTERS

FIELD OF THE INVENTION

The present invention relates to an electric paper cutter wherein the operation mechanism of the pressing board is driven by a motor which is stopped when the pressing board presses on the paper pile.

BACKGROUND OF THE INVENTION

A pressing board assembly 60 of a conventional manual paper cutter is disclosed in FIG. 4, and generally includes a threaded rod 61 which is operated by rotating a wheel 62 connected to on end thereof and two guide members 64 each have a rack portion which are engaged with the threads of the threaded rod 61. The two guide members 64 are pivotably connected to two first links 63 respectively and the two first links 63 are pivotably connected to two respective first ends of two second links 65. The two respective second ends of the two second links 65 are pivotably connected to a pressing board 66. Two ends of the pressing board 66 are movably retained between two guide boards 67. By rotating the wheel 62, the pressing board 66 is lowered to press onto a pile of paper (not shown) and a cutting mechanism is activated to cut the pile of paper. It takes a lot of time to lower or to lift the pressing board 66 by rotating the wheel 62.

FIGS. 5 and 6 show an operation mechanism 70 for an electric paper cutter wherein the threaded rod 700 is connected to a first belt wheel 71 and a belt 72 reeves between the first belt wheel 71 and the second belt wheel 74 connected to an end of a driving rod 75 which is driven by a motor 73. The threaded rod 700 are engaged with two rack members which are respectively and pivotably connected to two first links 76. The two first links 76 are pivotably connected to two respective first ends of two second links. The two respective second ends of the two second links are pivotably connected to a pressing board 77. When activating the motor 73, the first and second belt wheels 71, 74 are rotated by the belt 72 so that the threaded rod 700 is rotated to activate the rack members, first links 76 and the second links to lower or lift the pressing board 77. Nevertheless, the user has to carefully calculate the time of the operation of the motor 73 so that the motor 73 will not overdrive after the pressing board 77 presses on the pile of paper.

The present invention intends to provide an operation mechanism for operation of pressing board of an electric paper cutter wherein the travel of the pressing board is controlled by sensors which send commands to stop the motor when the pressing board presses on the pile of paper.

SUMMARY OF THE INVENTION

The present invention relates to a pressing board operation mechanism for electric paper cutters and the mechanism comprises a driving assembly which has a motor which drives a driving and a transmission wheel is driven by the driving gear. A driving rod has an end eccentrically connected to the transmission wheel and the other end of the driving rod is pivotably connected to a first link assembly which includes two first plates and two second plates. The first plates are pivotably connected to one of the two side fixing portions and the other end of the driving rod is pivotably connected to the two first plates. A pivotable member is pivotably clamped between the two first plates and a push rod has a threaded end which extends through a sleeve, a spring, a washer, a hole in the pivotable member and is threadedly connected to an adjusting nut. The spring is received in the sleeve and rested on a first flange extending from an inner periphery of a first end the sleeve. The adjusting nut extends through the hole in the pivotable member and is in contact with the spring. A second flange extends from an outer periphery of a second end of the sleeve. The two second plates are pivotably connected to the frame and the other end of the push rod is pivotably connected to the two second plates. A first end of a connection plate is pivotably connected to the second plates. Two sensors are connected to the frame and the first plate respectively, and the two sensors can be activated by the flange of the sleeve and a side of the two second plates respectively.

A second link assembly has a rack member which has two rack portions on two sides thereof. A second end of the connection plate is pivotably connected to the rack member. Two first links are pivotably connected to a side board and each of the first links has a rack end which is engaged with one of the rack portions of the rack member. Two limitation boards are pivotably connected between the rack member and the two first links. Two second links each have a first end pivotably connected to the first link corresponding thereto and a second end of each of the second links is pivotably connected to the pressing board.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
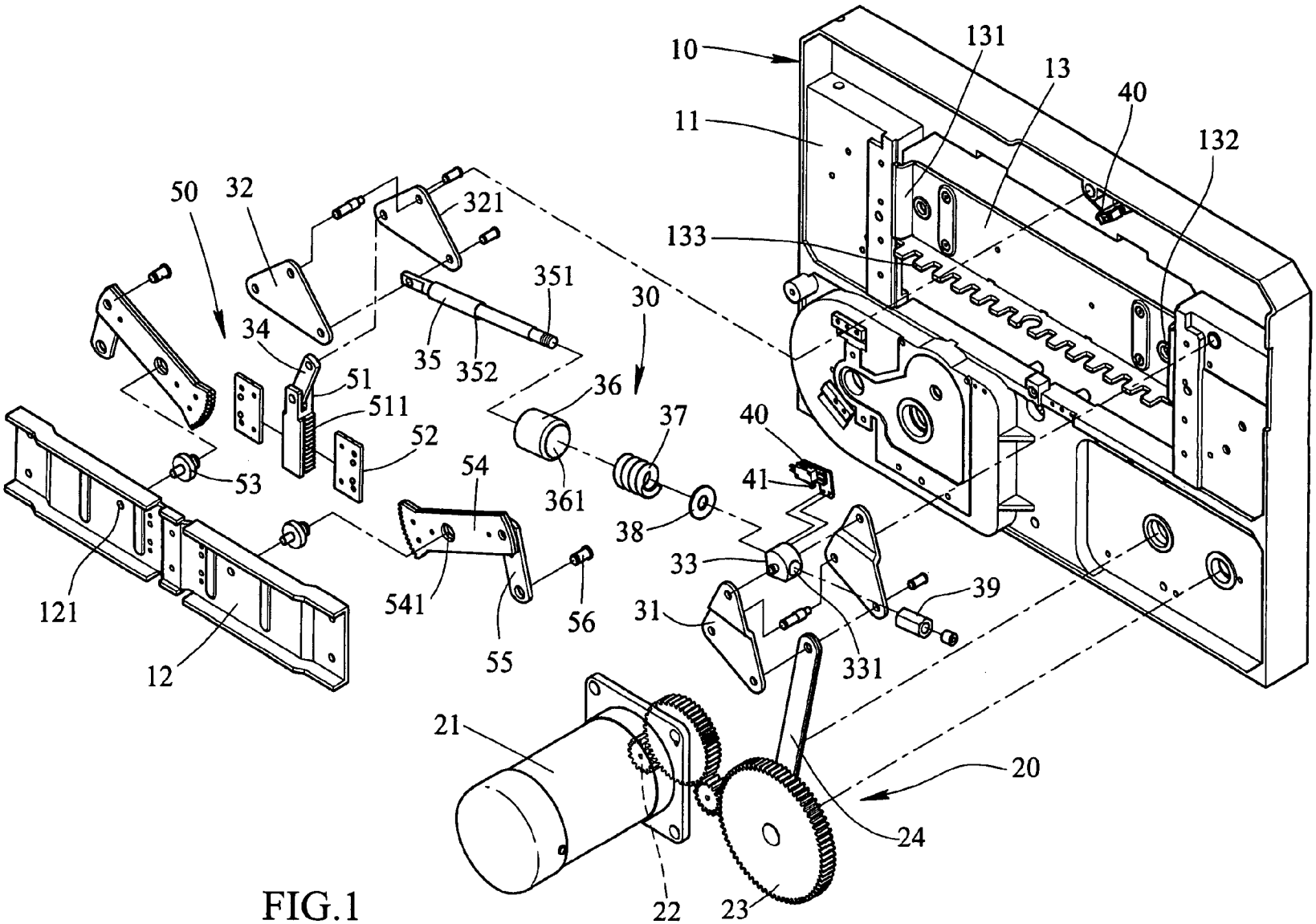
FIG. 1 is an exploded view to show the pressing board operation mechanism of the present invention.
Figure 2:
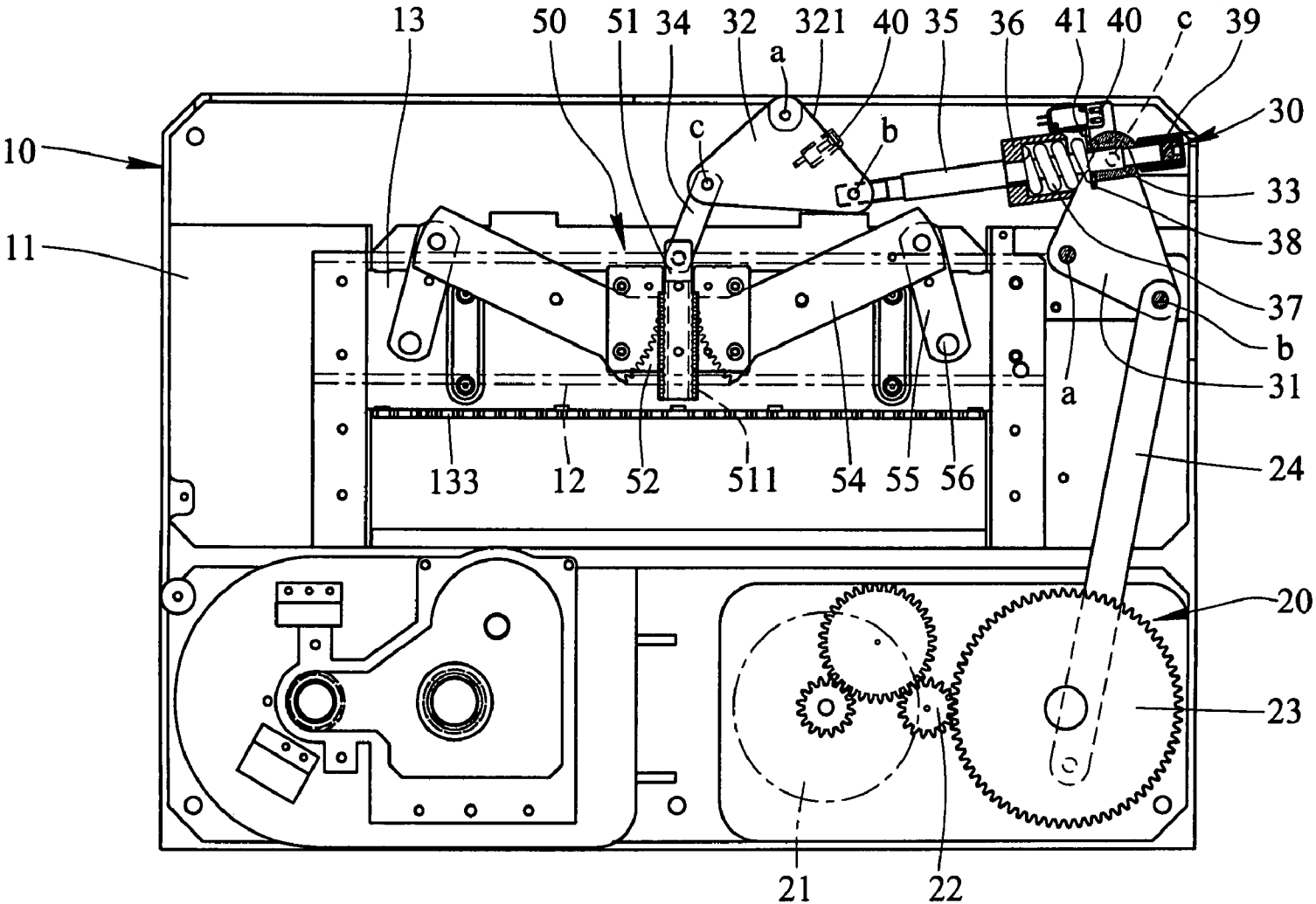
FIG. 2 is a plane view to show the pressing board operation mechanism of the present invention.
Figure 3A:
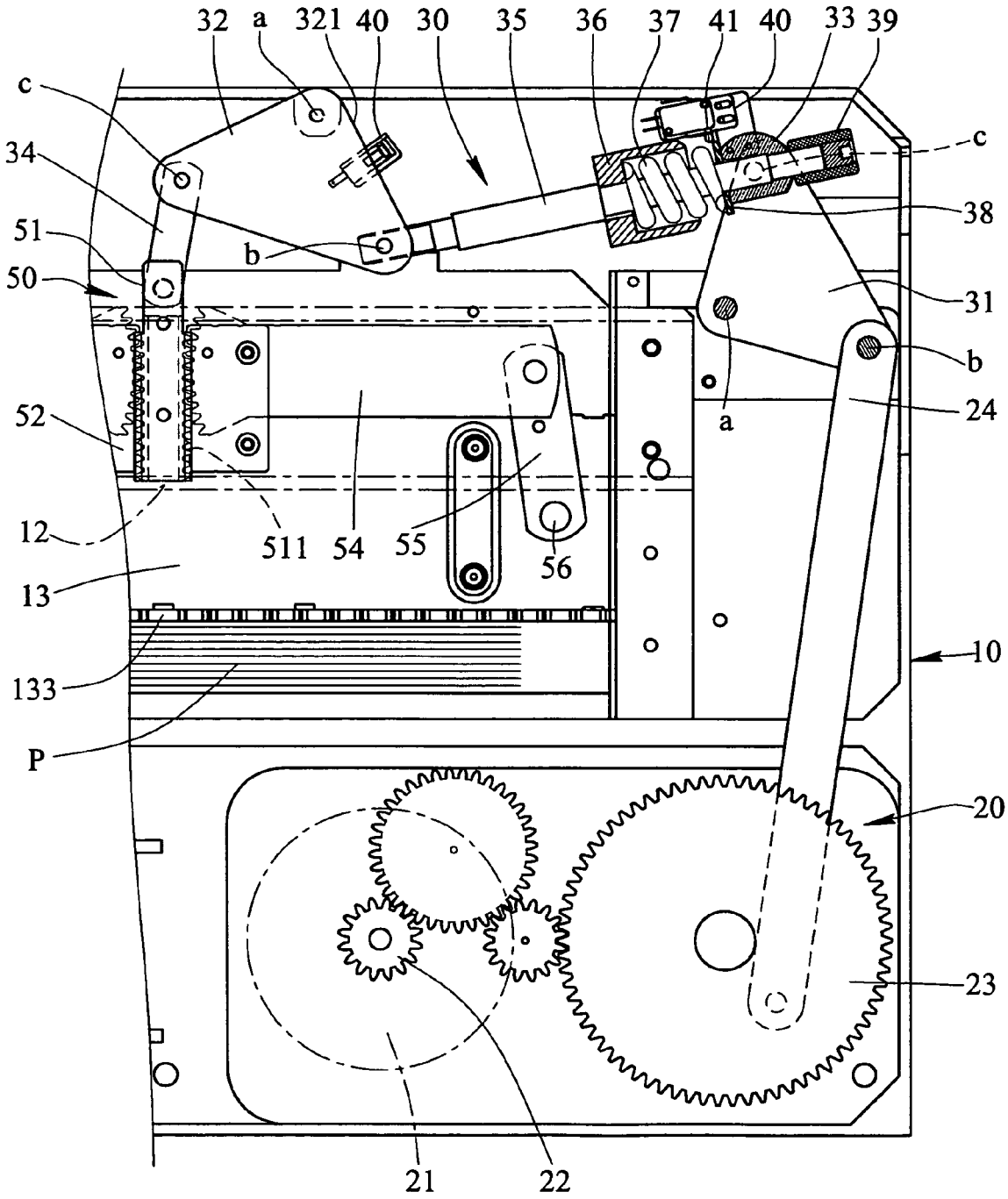
FIG. 3A shows the pressing board is lowered to press on the pipe of paper.

Referring to FIGS. 1, 2 and 3A, the pressing board operation mechanism for electric paper cutters of the present invention comprises a frame 10 with a pressing board 13 movably connected between two side fixing portions 11. The pressing board 13 has two bending ends 131 which are movably engaged with the two side fixing portions 11. A horizontal pressing portion 133 extends from a lower end of the pressing board 13.

A driving assembly 20 includes a motor 21 and a driving gear 22 which is driven by the motor 21. A transmission wheel 23 is driven by the driving gear 22 and a driving rod 24 has an end eccentrically connected to the transmission wheel 23.

A first link assembly 30 has two first plates 31 and two second plates 32. The first plates 31 each have a first point "a" pivotably connected to one of the two side fixing portions 11 and the other end of the driving rod 24 is pivotably connected to a second point "b" of the two first plates 31. A pivotable member 33 is pivotably clamped between the two first plates 31 at a third point "c" of the first plates 31. A push rod 35 has a threaded end 351 which extends through a sleeve 36, a spring 37, a washer 38, a hole 331 in the pivotable member 33 and is threadedly connected to an adjusting nut 39. The spring 37 is received in the sleeve 36 and rested on a first flange extending from an inner periphery of a first end the sleeve 36. The push rod 35 has a protrusion 352 extending radially outward from a mediate portion thereof and the first end of the sleeve 36 is stopped by the protrusion 352 when the spring 37 is compressed. The adjusting nut 39 extends through the hole 331 in the pivotable member 33 and is in contact with the spring 37. A second flange 361 extends from an outer periphery of a second end of the sleeve 36. The two second plates 32 each have a first point pivotably connected to the frame 10 and the other end of the push rod 35 is pivotably connected to a second point of the two second plates 32. A third point of the second plates 32 is pivotably connected to a first end of a connection plate 34.

Two sensors 40 such as limit switches are respectively connected to the frame 10 and the pivotable member 33. The sensor 40 connected to the pivotable member 33 is activated by the flange 361 of the sleeve 36 and the other sensor 40 on the frame 10 can be activated by a side of the two second plates 32.

A second link assembly 50 has a rack member 51 which has two rack portions 511 on two sides thereof and a second end of the connection plate 34 is pivotably connected to the rack member 51. Two first links 54 are pivotably connected to a side board 12 at holes 121 in the side board 12 by pins 53, and each of the first links 54 has a rack end which is engaged with one of the rack portions 511 of the rack member 51. Two limitation boards 52 are pivotably connected between the rack member 51 and the two first links 54. Two second links 55 each have a first end pivotably connected to the first link 54 corresponding thereto and a second end of each of the second links 55 is pivotably connected to the holes 132 of the pressing board 13.

Figure 3B:
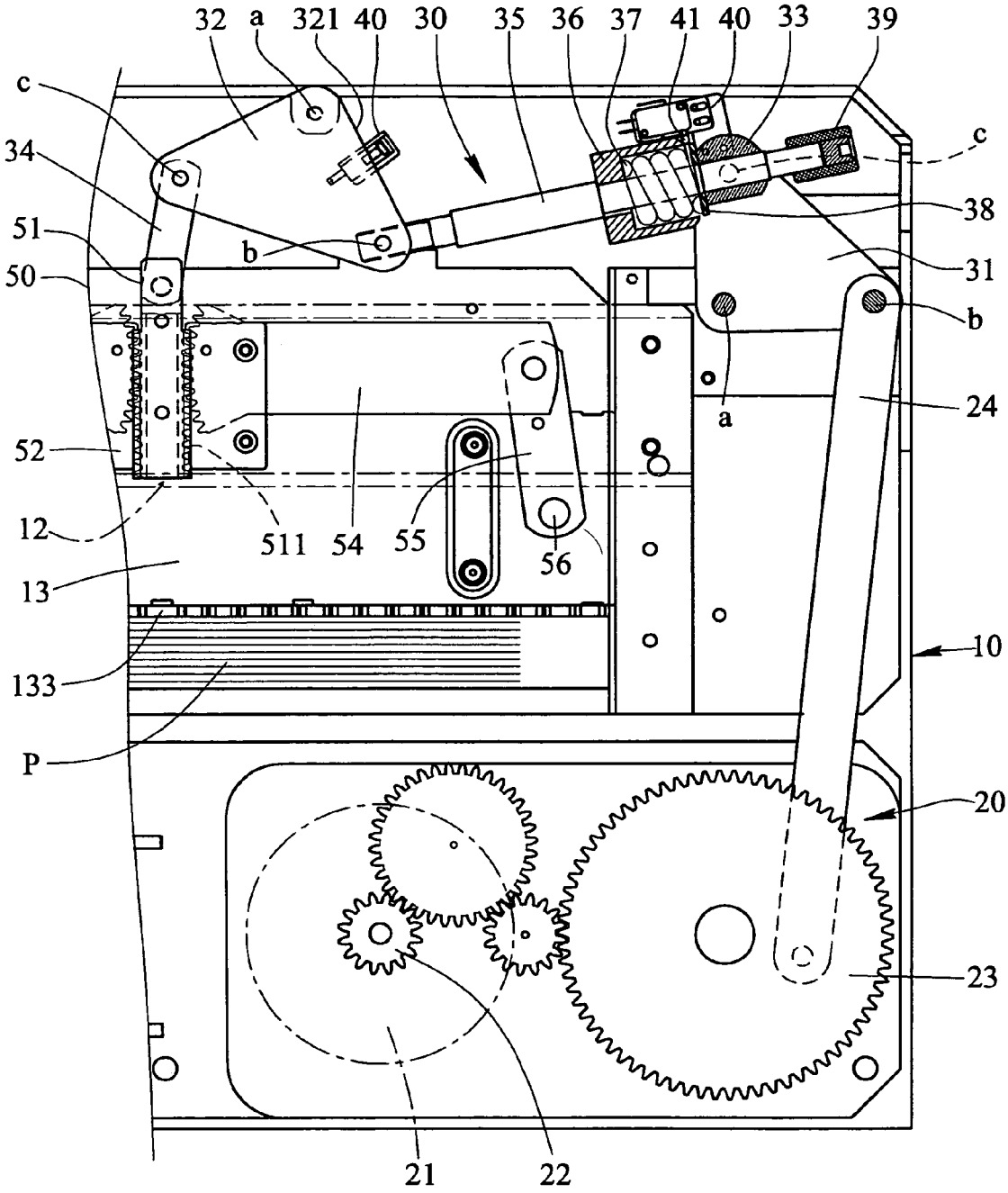
FIG. 3B shows that the sensors are activated to stop the motor.
Figure 4:
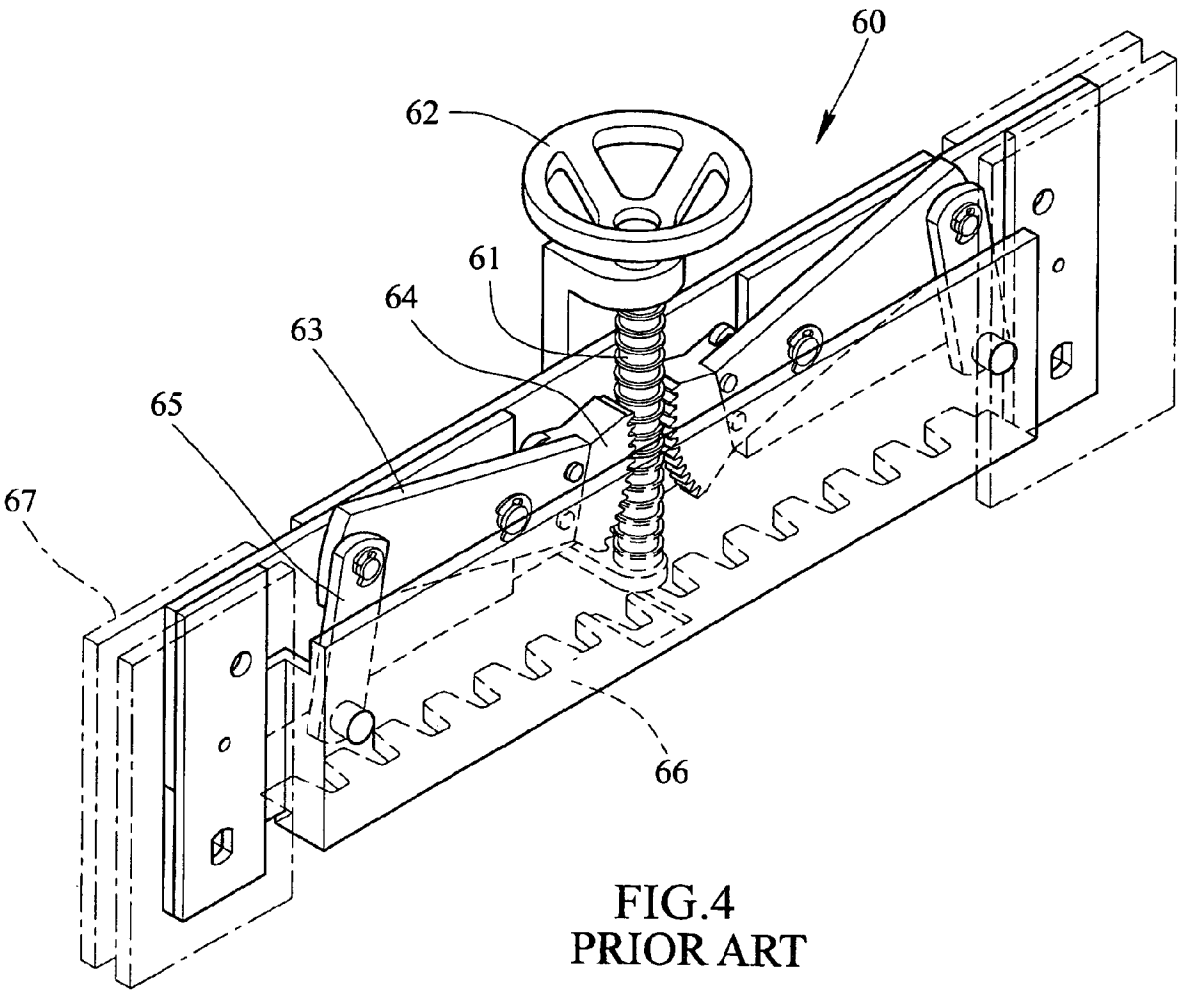
FIG.4 PRIOR ART
FIG. 4 shows a manual paper cutter.
Figure 5:
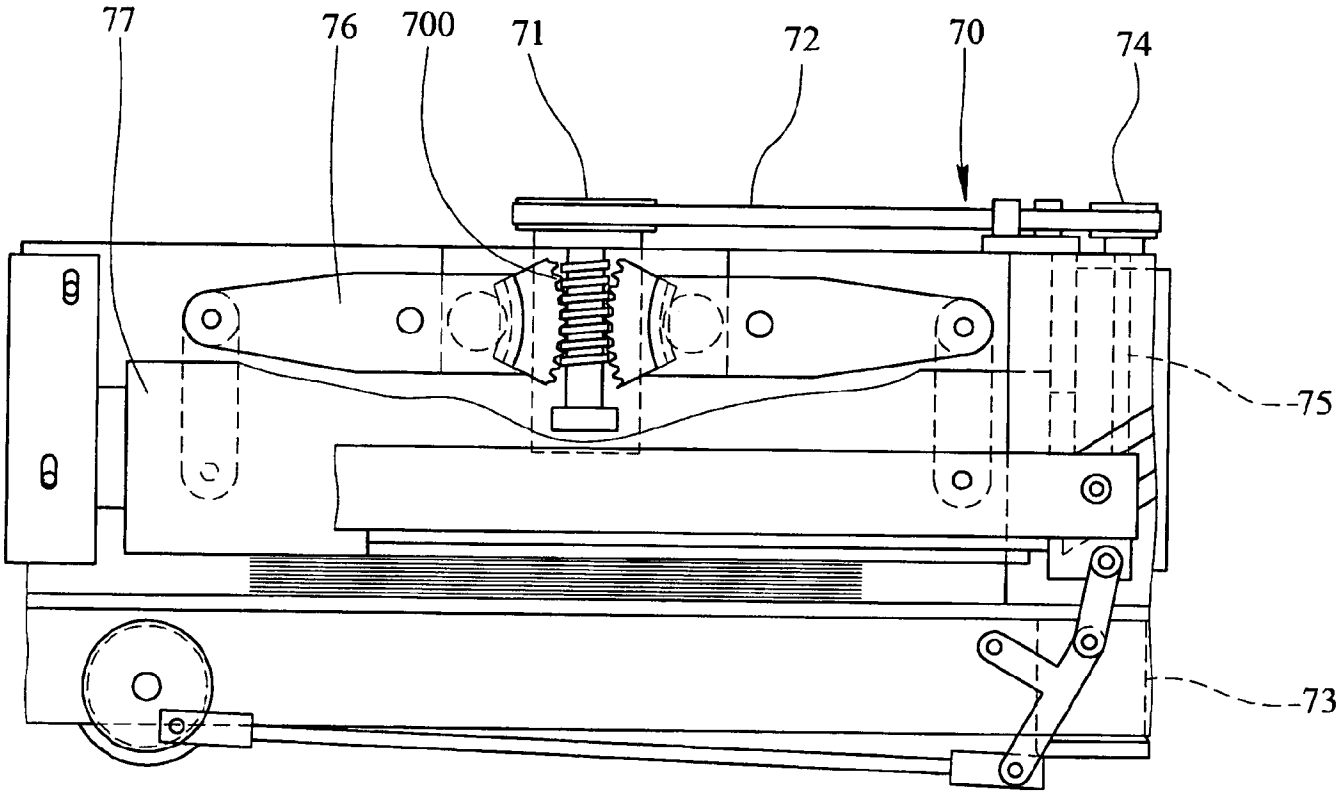
FIG.5 PRIOR ART
FIG. 5 shows the pressing board operation mechanism of a conventional electric paper cutter.
Figure 6:
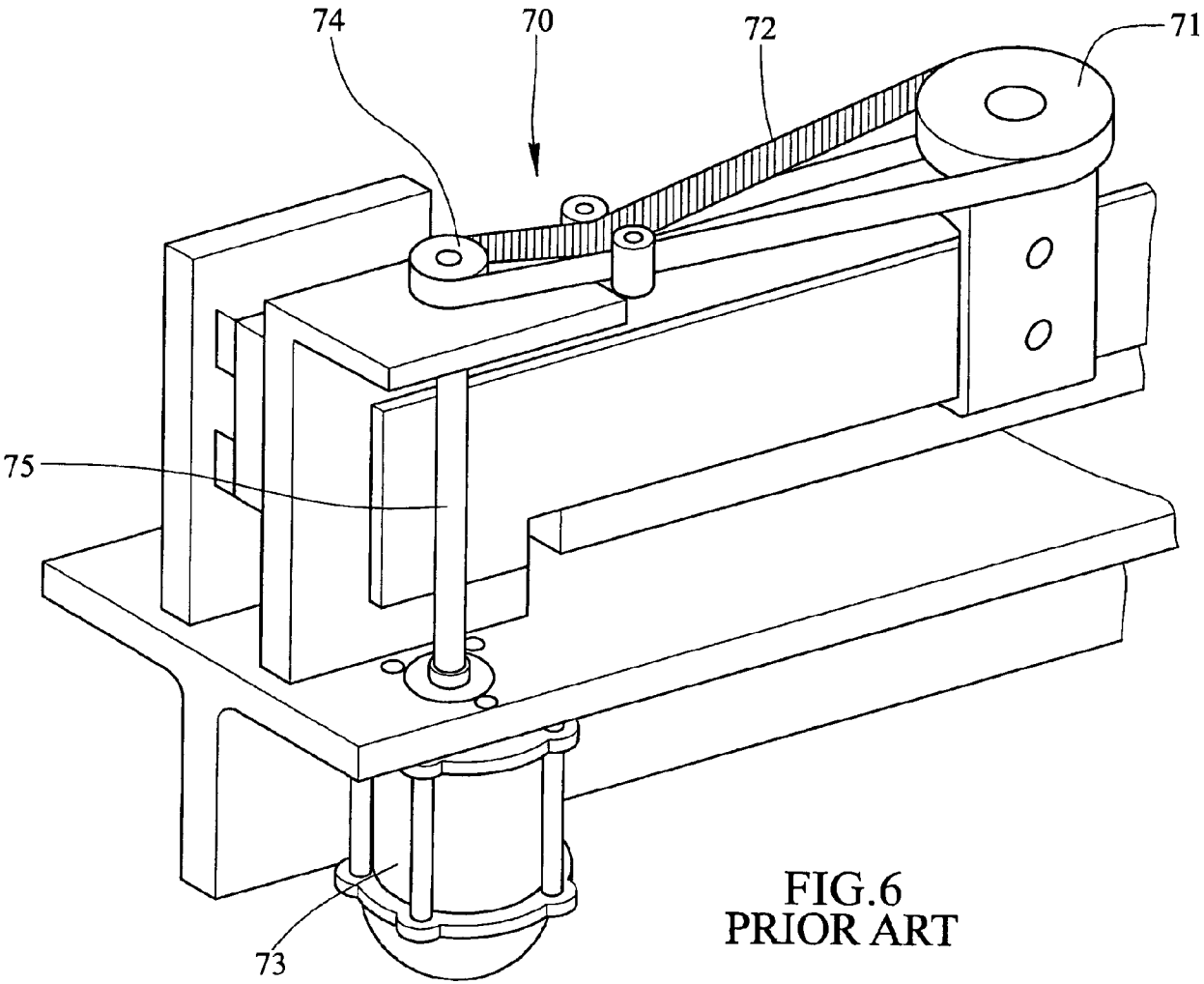
FIG.6 PRIOR ART
FIG. 6 shows a perspective view of the pressing board operation mechanism of the conventional electric paper cutter in FIG. 5.

As shown in FIG. 3B, when a pile of paper "P" is put beneath of the pressing board 13, the motor 21 is activated and the driving rod 24 pushes the first plates 31 which are pivoted about the point "a" and the point "c" moves toward the second plates 32 by the push rod 35. The second plates 32 are pivoted to lift the connection plate 34 so as to lift the rack member 51. The movement of the rack member 51 pivots the first links 54 and the second links 55 to push the pressing board 13 downward to press on the pile of paper "P". As the motor 21 drives the driving rod 24 when the pressing board 13 has already pressed on the pile of paper "P", the spring 37 is compressed by the adjusting nut 39 till the sleeve 36 is stopped by the protrusion 352 on the push rod 35. The pivotable member 33 pushes the spring 37 to overcome a reaction force from the pile of paper "P" so as to let the pressing board 13 firmly press on the pile of paper "P". The sensor 40 connected to the pivotable member 33 is then activated by the flange 361 of the sleeve 36 and the other sensor 40 on the frame 10 can be activated by a side of the two second plates 32. The sensors 40 send commands to stop the motor 21. That is to say, the motor 21 is stopped when the pressing board 13 presses on the pile of paper "P" automatically.

The compression of the spring 37 can be adjusted by rotating the adjusting nut 39 on the threaded end 351 of the push rod 35 so that the force used for overcoming the reaction force from the pile of paper "P" can be adjusted.

The motor 21 automatically stops and is protected when pressing the pile of paper "P" and the user needs not to check the time to turn off the motor 21.

While we have shown and described the embodiment in accordance with the present invention, it should be clear to those skilled in the art that further embodiments may be made without departing from the scope of the present invention.

What is claimed is:

1. A pressing board operation mechanism for electric paper cutters, comprising:

a frame with a pressing board movably connected between two side fixing portions;

a driving assembly having a motor and a driving gear which is driven by the motor, a transmission wheel driven by the driving gear, a driving rod having an end eccentrically connected to the transmission wheel;

a first link assembly having two first plates and two second plates, the first plates each having a first point "a" pivotably connected to one of the two side fixing portions, the other end of the driving rod pivotably connected to a second point "b" of the two first plates, a pivotable member pivotably clamped between the two first plates at a third point "c" of the first plates, a push rod having a threaded end which extends through a sleeve, a spring, a washer, a hole in the pivotable member and is threadedly connected to an adjusting nut, the spring received in the sleeve and rested on a first flange extending from an inner periphery of a first end the sleeve, the adjusting nut extending through the hole in the pivotable member and being in contact with the spring, a second flange extending from an outer periphery of a second end of the sleeve, the two second plates each having a first point pivotably connected to the frame, the other end of the push rod pivotably connected to a second point of the two second plates, a third point of the second plates pivotably connected to a first end of a connection plate;

two sensors connected to the frame and the pivotable member respectively, the sensor connected to the pivotable member being activated by the flange of the sleeve and the other sensor on the frame being activated by a side of the two second plates, and a second link assembly having a rack member which has two rack portions on two sides thereof, a second end of the connection plate pivotably connected to the rack member, two first links pivotably connected to a side board and each of the first links having a rack end which is engaged with one of the rack portions of the rack member, two limitation boards pivotably connected between the rack member and the two first links, two second links each having a first end pivotably connected to the first link corresponding thereto and a second end of each of the second links pivotably connected to the pressing board.

2. The mechanism as claimed in claim 1, wherein the push rod has a protrusion extending radially outward from a mediate portion thereof and the first end of the sleeve is stopped by the protrusion when the spring is compressed.

3. The mechanism as claimed in claim 2, wherein the sensors are limit switches.

* * * * *